United States Patent [19]

Kobayashi et al.

[11] 4,440,119

[45] Apr. 3, 1984

[54] ELECTRONIC FUEL INJECTING METHOD AND DEVICE FOR INTERNAL COMBUSTION ENGINE

[75] Inventors: Nobuyuki Kobayashi, Toyota; Toshiaki Isobe, Nagoya, both of Japan

[73] Assignee: Toyota Jidosha Kogyo Kabushiki Kaisha, Toyota, Japan

[21] Appl. No.: 391,432

[22] Filed: Jun. 23, 1982

[30] Foreign Application Priority Data

Feb. 2, 1982 [JP] Japan ..... 57-15097

[51] Int. Cl.[3] ..... F02D 5/02

[52] U.S. Cl. ..... 123/492; 123/493

[58] Field of Search ..... 123/492, 493, 480, 486

[56] References Cited

U.S. PATENT DOCUMENTS

| | | | |
|---|---|---|---|
| 4,184,458 | 1/1980 | Aoki et al. | 123/492 |
| 4,245,605 | 1/1981 | Rice et al. | 123/492 |
| 4,356,803 | 11/1982 | Miyagi | 123/492 |
| 4,359,993 | 11/1982 | Carlson | 123/492 |

*Primary Examiner*—Andrew M. Dolinar

*Attorney, Agent, or Firm*—Cushman, Darby & Cushman

[57] ABSTRACT

In an electronic fuel injecting method and device for an internal combustion engine, wherein a basic injection time is obtained in accordance with an intake pressure of the engine and an engine rotational speed, and, during transition, the basic injection time is corrected in accordance with the operating conditions of the engine so as to determine a fuel injection time, when a change in value of the intake pressure in every first predetermined time period exceeds a first criterion value, an increase correction for acceleration or a decrease correction for deceleration is effected, in case the change in value of the intake pressure in every first predetermined time period does not exceed the first criterion value, if a change in value of the intake pressure in every second predetermined time period being longer than the first predetermined time period exceeds a second criterion value, at least an increase correction for acceleration is effected, and if the change in value of the intake pressure does not exceed the second criterion value, neither an increase correction for acceleration nor a decrease correction for deceleration is effected, and further, if necessary, when the change in value of the intake pressure after the first predetermined time period has elapsed exceeds the first criterion value, the count starting point of the second predetermined time period is made to be the time at which the first predetermined time period has elapsed.

9 Claims, 6 Drawing Figures

ELECTRONIC FUEL INJECTING METHOD AND DEVICE FOR INTERNAL COMBUSTION ENGINE

BACKGROUND OF THE INVENTION

1. Field of the Invention

This invention relates to an electronic fuel injecting method and device for an internal combustion engine, and more particularly to improvements in an electronic fuel injecting method and device suitable for use in an internal combustion engine for a motor vehicle having a D-J type electronic fuel injection system, wherein a basic injection time is obtained in accordance with an intake pressure of the engine and an engine rotational speed, and, during transition, the basic injection time is corrected in accordance with the operating conditions of the engine so as to determine a fuel injection time.

2. Description of the Prior Art

The methods of supplying a mixture of a predetermined air-fuel ratio to combustion chambers of an internal combustion engine for a motor vehicle and the like include one using an electronic fuel injection system. According to this method, a plurality of injectors as many as the number of cylinders of the engine or one injector for the injection of fuel into the engine are provided, for example, on an intake manifold or a throttle body of the engine, and the valve-opening time period of the injectors or injector is controlled in accordance with the operating conditions of the engine, so that a mixture of a predetermined air-fuel ratio can be supplied to the combustion chambers of the engine. This electronic fuel injection system is broadly divided into two systems including a so-called L-J type electronic fuel injection system wherein a basic injection time is obtained in accordance with an intake air flowrate of the engine and an engine rotational speed and a so-called D-J type electronic fuel injection system wherein a basic injection time is obtained in accordance with an intake pressure of the engine and an engine rotational speed.

The former can control the air-fuel ratio with high accuracy and is commonly used for the engines of motor vehicles to which is applied exhaust gas purification system. However, in this L-J type electronic fuel injection system, the dynamic range of the intake air flowrate is so wide that the intake air flowrate at the time of high load is increased to about 50 times that at the time of idling, thereby presenting the following disadvantages. Namely, not only the accuracy is decreased when the intake air flowrate is converted into a digital signal, but also a bit length of the digital signal is lengthened when it is desired to improve the counting accuracy in a digital control circuit at the latter stage, whereby an expensive computer is required for the digital control circuit, and moreover, a measuring instrument having a construction with high accuracy such as an air flow meter or the like is required to measure the intake air flowrate, to thereby increase the installation cost.

On the other hand, the latter D-J type electronic fuel injection system has the features that the dynamic range of the intake pressure is so narrow that the variation value of the intake pressure is as low as two to three times, so that, not only the operation in the digital control circuit at the latter stage is facilitated, but also a pressure sensor for detecting the intake pressure is inexpensive. However, as compared with the L-J type electronic fuel injection system, the D-J type electronic fuel injection system has a low control accuracy of the air-fuel ratio, and particularly, has a low acceleration performance during acceleration because the fuel injection time is not increased unless the intake pressure increases, whereby the air-fuel ratio becomes lean temporarily. To obviate the disadvantages as described above, heretofore, there has been taken a measure that an increase correction for acceleration is provided in response to a pulse train fed from a comb-shaped sensor provided on a throttle valve. However, in order to improve the driverability, it is necessary to increase the increase correction to a considerable extent. In that case, the air-fuel ratio has become over-rich, the value of carbon monoxide contained in the exhaust gas has increased to an unusually high extent, so that the air-fuel ratio could not be maintained within a predetermined range suitable for a three-way catalytic converter. This is also true of the case where the fuel injection time is feedback controlled in response to an oxygen concentration sensor provided at the downstream side of the exhaust gas, because the oxygen concentration sensor is slow in response. In consequence, heretofore, it has been conceived that it is difficult to use the D-J type electronic fuel injection system in the engine for the motor vehicle, to which the exhaust gas purification system is applied, requiring the air-fuel ratio control with high accuracy.

Furthermore, in the D-J type electronic fuel injection system, the fuel injection time is not decreased during deceleration unless the intake pressure decreases, whereby the air-fuel ratio becomes rich temporarily, thus proving to be low in the exhaust gas purification performance.

SUMMARY OF THE INVENTION

The present invention has been developed to obviate the above-described disadvantages of the prior art and has as its first object the provision of an electronic fuel injecting method for an internal combustion engine, capable of effecting suitable increase or decrease correction during acceleration or deceleration in accordance with a change of intake pressure, so as to maintain an air-fuel ratio in the vicinity of the stoichiometrical air-fuel ratio, and consequently, capable of making a satisfactory acceleration-deceleration performance compatible with an exhaust gas purification performance.

The present invention has as its second object in addition to its first object the provision of an electronic fuel injecting method for an internal combustion engine, wherein an increase or decrease correction due to one and the same change is prevented from being dually performed so that an increase correction for acceleration or a decrease correction for deceleration can avoid becoming excessive.

Further, the present invention has as its third object the provision of an electronic fuel injection device for an internal combustion engine, wherein the first object is achieved.

The present invention has as its fourth object the provision of an electronic fuel injection device for an internal combustion engine, wherein the second object is achieved by a comparatively short program.

To achieve the first object, the present invention contemplates that, in an electronic fuel injecting method for an internal combustion engine, wherein a basic injection time is obtained in accordance with an intake pressure of the engine and an engine rotational speed, and, during transition, the basic injection time is corrected in accordance with the operating conditions of the engine so as to determine a fuel injection time, when a change in value of the intake pressure in every first predetermined time period exceeds a first criterion value, an increase correction for acceleration or a decrease correction for deceleration is effcted, in case the change in value of the intake pressure in every first predetermined time period does not exceed the first criterion value, if a change in value of the intake pressure in every second predetermined time period being longer than the first predetermined time period exceeds a second criterion value, at least an increase correction for acceleration is effected, and if the change in value of the intake pressure does not exceed the second criterion value, neither an increase correction for acceleration nor a decrease correction for deceleration is effected.

To achieve the second object, the present invention contemplates that, in an electronic fuel injecting mehtod for an internal combustion engine like above, when a chnage in value of the intake pressure in every first predetermined time period exceeds a first criterion value, an increase correction for acceleration or a decrease correction for deceleration is effected, in case the change in value of the intake pressure in every first predetermined time period does not exceed the first criterion value, if a change in value of the intake pressure in every second predetermined time period being longer than the first predetermined time period exceeds a second criterion value, at least an increase correction for acceleration is effected, and, if the change in value of the intake pressure does not exceed the second criterion value, neither an increase correction for acceleration nor a decrease correction for deceleration is effected, and further, when the change in value of the intake pressure after the first predetermined time period has elapsed exceeds the first criterion value, the count starting point of the second predetermined time period is made to be the time at which the first predetermined time period has elapsed.

To achieve the third object, the present invention contemplates that an electronic fuel injection device for an internal combustion engine comprises:

an intake air temperature sensor for detecting the temperature of intake air taken in by an air cleaner;

a throttle sensor including an idle switch for detecting whether a throttle valve is in an idle opening or not and a potentiometer for generating a voltage output proportional to the opening of the throttle valve;

an intake pressure sensor for detecting an intake pressure through a pressure in a surge tank;

an injector for blowing fuel out into the engine;

a crank angle sensor for outputting a crank angle signal in accordance with a rotation of the engine;

a coolant temperature sensor for detecting the temperature of engine coolant; and a digital control circuit wherein a basic injection time is obtained through a map in accordance with an intake pressure fed from the intake pressure sensor and an engine rotational speed obtained from an output from the crank anagle sensor, the basic injection time thus obtained is corrected in accordance with an output from the throttle sensor and the temperature of engine coolant fed from the coolant temperature sensor and the like to determine a fuel injection time and output an injector opening time signal to the injector, and further, to obtain an increase correction value for acceleration or a decrease correction value for deceleraton, there are combined three values including an after-idle increase correction in which a correction value is increased to a predetermined level when the idel switch is turned "OFF", a throttle valve opening increase or decrease correction in which a correction value is obtained in accordance with a changing speed in opening of a throttle valve as detected from an output from the potentiometer of the throttle sensor, and an intake pressure increase or decrease correction in which, in accordance with a changing speed of an intake pressure as detected from an ouput from the intake pressure sensor, when a change in value of the intake pressure in every first predetermined time period exceeds a first criterion value, an increase correction for acceleration or a decrease correction for deceleration is effected, in case the change in value of the intake pressure in every first predetermined time period does not exceed the first criterion value, if a change in value of the intake pressure in every second predetermined time period being longer than the first predetermined time period exceeds a second criterion value, an increase correction for acceleration or a decrease correcion for deceleration is effected, and if the change in value of the intake pressure does not exceed the second criterion value, neither an increase correction for acceleration nor a decrease correction for deceleration is effected.

To achieve the fourth object, the present invention contemplates that an electronic fuel injecton device for an internal combustion engine comprises:

an intake air temperature sensor for detecting the temperature of intake air taken in by an air clerner;

a throttle sensor including an idle switch for detecting whether a throttle valve is in an idle opening or not and a potentiometer for generating a voltage output proportional to the opening of the throttle valve;

an intake pressure sensor for detecting an intake pressure through a pressure in a surge tank;

an injector for blowing fuel out into the engine;

a crank angle sensor for outputting a crank angle signal in accordance with a rotation of the engine;

a coolant temperature sensor for detecting the temperature of engine coolant; and a digital control circuit wherein a basic injection time is obtained through a map in accordance with an intake pressure fed from the intake pressure sensor and an engine rotational speed obtained from an output from the crank angle sensor, the basic injection time thus obtained is corrected in accordance with an output from the throttle sensor and the temperature of engine coolant fed from the coolant temperature sensor and the like to determine a fuel injection time and output an injector opening time signal to the injector, and further, to obtain an increase correction value for acceleration or a decrease correction value for deceleration, there are combined three values including an after-idle increase correction in which a correction value is increased to a predetermined level when the idle switch is turned "OFF", a throttle valve opening increase or decrease correction in which a correction value is obtained in accordance with a changing speed in opening of a throttle valve as detected from an output from the potentiometer of the throttle sensor, and an intake pressure increase or descrease correction in which, in accordance with a changing speed of an intake pressure as detected from an output from the intake pressure sensor, when a change in value of the intake pressure in every first predetermined time period exceeds a first criterion value, an increase correction for acceleration or a decrease correction for deceleration is effected, in case the change in value of the intake pressure in every first predetermined time period does not exceed the first criterion value, if a change in value of the intake pressure in every second predetermined time period being longer than the first predetermined time period exceeds a second criterion value, only an increase correction for acceleration is effected, and if the change in value of the intake pressure does not exceed the second criterion value, neither an increase correction for acceleration nor a decrease correction for deceleration is effected, and further, when the change in value of the intake pressure after the first predetermined time period has been elapsed exceeds the first criterion value, the count starting point of the second predetermined time period is made to be the time at which the first predetermined time period has elapsed.

According to the present invention, an increase correction for acceleration or a decrease correction for deceleration in accordance with a change of intake pressure can be quickly and accurately effected, and the air-fuel ratio can be maintained in the vicinity of the stoichiometrical air-fuel ratio, so that a satisfactory acceleration or deceleration performance can be made compatible with an exhaust gas purification performance. In consequence, even when a D-J type electronic fuel injecton system is used, an accurate air-fuel ratio control can be effected.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE INVENTION

Detailed description will hereunder be given of the embodiments of the present invention with reference to the drawings.

Figure 1:
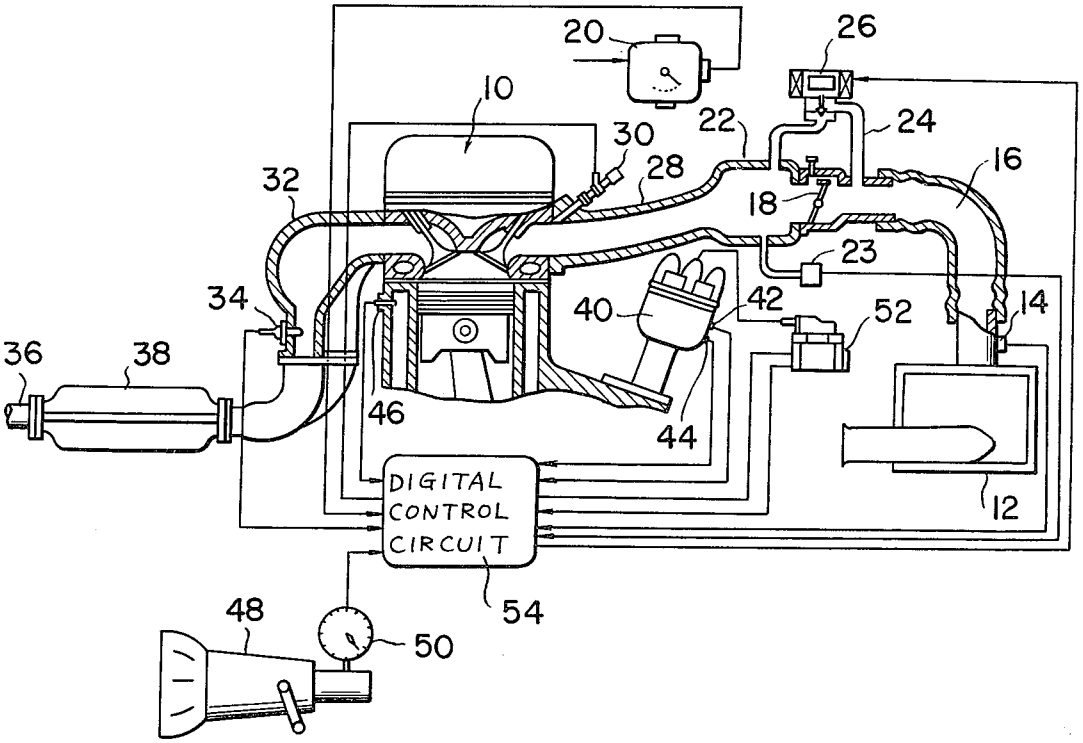
FIG. 1 is a block diagram showing a first embodiment of a D-J type electronic fuel injection device of an engine for a motor vehicle adopting the electronic fuel injecting method for an internal combustion engine according to the present invention.
Figure 2:
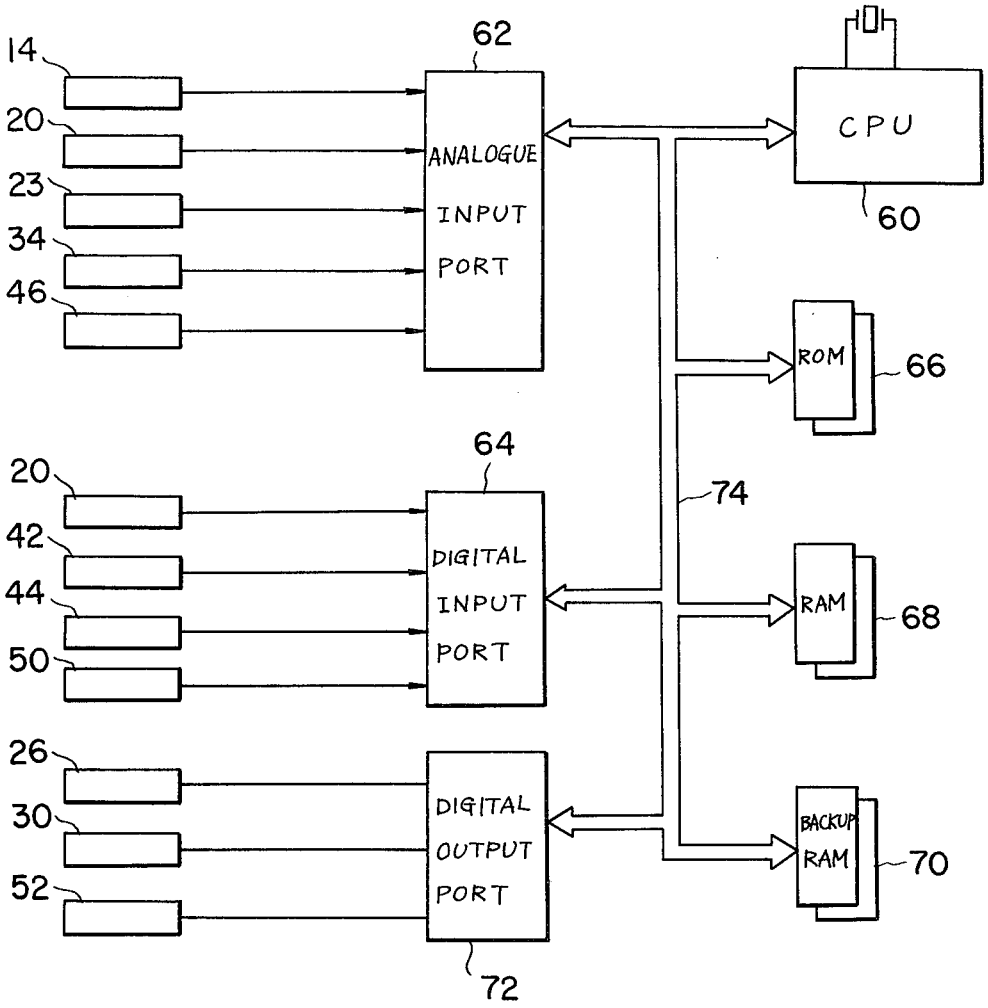
FIG. 2 is a block diagram showing the arrangement of the digital conrol circuit used in the first embodiment.

As shown in FIGS. 1 and 2, a first embodiment of the D-J type electronic fuel injection device of an engine 10 of a motor vehicle adopting the electronic fuel injecting method for an internal combustion engine according to the present invention, comprising:

an air cleaner 12 for taking in atmosphere;

an intake air temperature sensor 14 for detecting the temperature of intake air taken in through the aircleaner 12;

a throttle valve 18 provided in an intake air passage 16 and adapted to be interlocked with an accelerator pedal, not shown, provided around a driver's seat to be opened or closed, for controlling the flowrate of intake air;

a throttle sensor 20 including an idle switch for detecting whether the throttle valve 18 is in an idle opening or not and a potentiometer for generating a voltage output proportional to the opening of the throttle valve 18;

a surge tank 22;

an intake pressure sensor 23 for detecting the intake pressure from a pressure in the surge tank 22;

a bypass passage 24 for bypassing the throttle valve 18;

an idle speed control valve 26 provided at the intermediate portion of the bypass passage 24 for controlling the opening area of the bypass passage 24 to control an idle rotational speed;

an injector 30 for blowing fuel out into an intake port of the engine 10;

an oxygen concentration sensor 34 provided on an exhaust manifold 32 for detecting an air-fuel ratio from the residual oxygen concentration in the exhaust gas;

a three-way catalytic converter 38 provided at the intermediate portion of an exhaust pipe 36 at the downstream side of the exhaust manifold 32;

a distributor 40 having a distributor shaft rotatable in operational association with a crankshaft of the engine 10;

a top dead center sensor 42 and a crank angle sensor 44 incorporated in the distributor 40 for outputting a top dead center signal and a crank angle signal in accordance with the rotation of the distributor shaft, respectively;

a coolant temperature sensor 46 provided on an engine block for detecting the temperature of engine coolant;

a vehicle speed sensor 50 for detecting a running speed of the vehicle from the rotational speed of an output shaft of a transmission 48; and a digital control circuit 54, in which a basic injection time per cycle of the engine is obtained from a map in accordance with the intake pressure fed from the intake pressure sensor 23 and the engine rotational speed obtained from an output of the crank angle sensor 44, the basic injection time thus obtained is corrected in accordance with an output from the throttle sensor 20, an air-fuel ratio fed from the oxygen concentration sensor 34, the temperature of engine coolant fed from the coolant temperature sensor 46 and the like to determine a fuel injection time, whereby an injector opening time signal is fed to the injector 30, an ignition timing is determined in accordance with the operating condition of the engine to feed an igniting signal to a coil 52 provided thereon with an igniter, and further, the idle speed control valve 26 is controlled during idling;

is of such an arrangement that, in the digital control circuit 54, an after-idle increase correction in which a correction value is increased to a predetermined level when the idle switch of the throttle sensor 20 is turned "OFF", a throttle valve opening increase or decrease correction in which a correction value is obtained in accordance with a changing speed in opening of a throttle valve as detected from an output from the potentiometer of the throttle sensor 20, and an intake pressure increase or decrease correction in which, in accordance with a changing speed of an intake pressure as detected from an output from the intake pressure sensor 23, when a change in value of the intake pressure in every first predetermined time period exceeds a first criterion value, an increase correction for acceleration or a decrease correction for deceleration is effected, in case the change in value of the intake pressure in every first predetermined time period does not exceed the first criterion value, if a change in value of the intake peressure in every second predetermined time period being longer than the first predetermined time period exceeds a second criterion value, an increase correction for acceleration or a decrease correction for deceleration is effected, and if the change in value of the intake pressure does not exceed the second criterion value, neither an increase correction for acceleration nor a decrease correction for deceleration is effected, are combined to obtain an increase correction value for acceleration or a decrease correction value for deceleration.

As detailedly shown in FIG. 2, the digital control circuit 54 comprises:

a Central Processing Unit 60 (hereinafter referred to as "CPU") consisting of a microcomputer for performing various operations; an analogue input port 62 provided theron with a multiplexer for converting analogue signals fed from the intake air temperature sensor 14, the potentiometer of the throttle sensor 20, the intake pressure sensor 23, the oxygen concentration sensor 34, the coolant temperature sensor 46 and the like into digital signals and successively taking into CPU 60; a digital input port 64 for taking into CPU 60 with predetermined timings degial signals fed from the idle switch of the throttle sensor 20, the top dead center sensor 42, the crank angle sensor 44, the vehicle speed sensor 50 and the like; a Read Only Memory 66 (hereinafter referred to as "ROM") for storing programs, various constants or the like; a Random Access Memory 68 (hereinafter referred to as "RAM") for temporarily storing operation data in CPU 60 and the like; a backup Ramdom Access Memory 70 for being supplied thereto with current from an auxiliary power source, when the engine is stopped, to hold memory; a digital output port 72 for outputting the result of operation in CPU 60 with predetermined timings to the idle speed control valve 26, the injector 30, the coil 52 with the igniter and the like; and a common bus 74 for interconnecting the above-described components to one another.

Description will hereunder be given of action.

Firstly, the digital control circuit 54 reads out the basic injection time period TP(PM, NE) from the intake pressure PM fed from the intake pressure sensor 23 and the engine rotational speed calculated from an output of the crank angle sensor 44, through a map previously stored in ROM 66.

Subsequently, the basic injection time period TP (PM, NE) is corrected through the following equation in response to signals from the respective sensors so as to calculate a fuel injection time period TAU.

$$TAU = TP(PM, NE) \times (1 + K \times F) \quad (1)$$

where F is a coefficient of correction, and F indicates an increase correction value when it is positive in value, but a decrease correction value when negative. Additionally, K is a multiplying factor of correction for a further correction, and is normally represented by 1.

A fuel injection time signal corresponding to the fuel injection time period TAU thus determined is fed to the injector 30, whereby the injector 30 is opened only for the fuel injection time period TAU in synchronism with the engine rotation, so that fuel can be blown out into the intake manifold 28 of the engine 10.

The increase correction for acceleration or the decrease correction for deceleration in this embodiment is obtained in the following manner.

Figure 3:
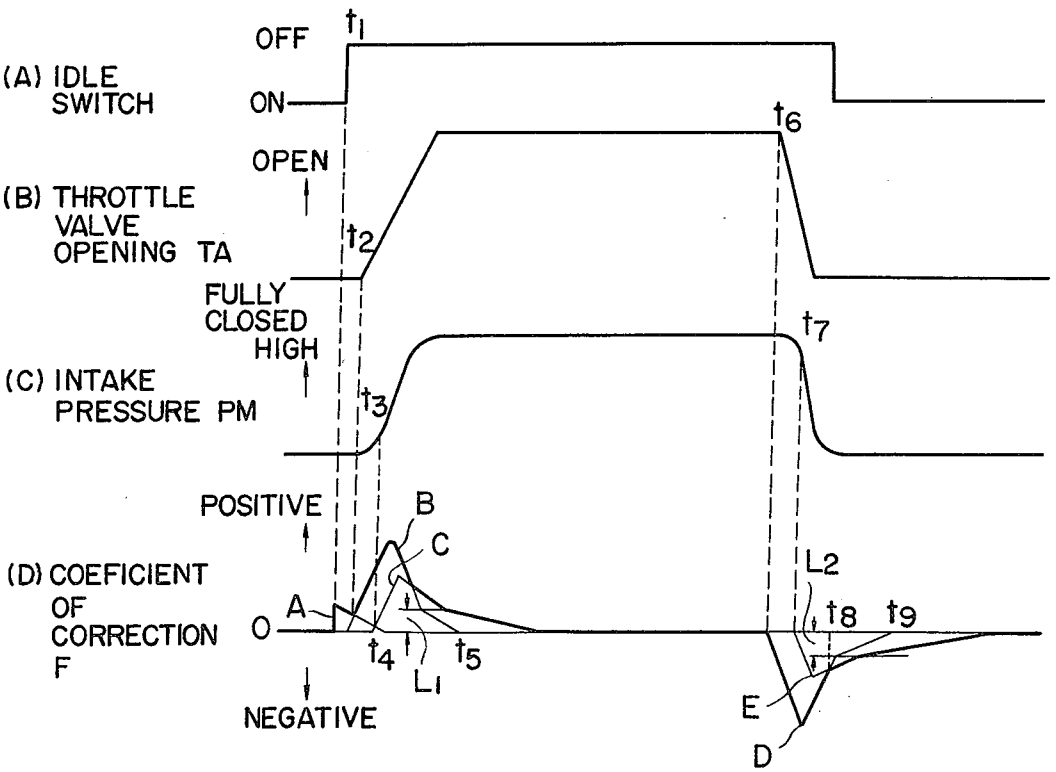
FIG. 3 is a graphic chart showing the conditions of an increase correction for acceleration and a decrease correction for deceleration in the first embodiment.

As shown in FIG. 3, if the accelerator pedal is depressed during acceleration and the idle switch of the throttle sensor 20 is turned "OFF" at the time $t_1$ as shown in FIG. 3(A), then, prior to increase in the throttle valve opening TA and the intake pressure PM, an after-idle increase correction (hereinafter referred to as "LL increase correction"), in which a very quick correction is obtained, is achieved. Specifically stating, for example, this LL increase correction value is obtained such, firstly, a coefficient F of correction is made to be a predetermined positive value, and subsequently, attenuated every rotation of the engine or every predetermined time interval at a predetermined attenuation rate to zero.

Subsequently, if the throttle valve 18 is further opened and the throttle valve opening TA detected from an output of the potentiometer of the throttle sensor 20 begins to rise from the time $t_2$ as shown in FIG. 3(B), then, prior to the increase in the intake pressure PM, the throttle valve opening increase correction (hereinafter referred to as "TA increase correction"), in which a quick correction is obtained in accordance with the increasing speed of the throttle valve opening TA, is achieved. Specifically stating, for example, this TA increase correction value is obtained such that a value (positive value) obtained by integrating values each corresponding to a varying value with every predetermined time of the throttle valve opening TA is made to be a coefficient F of correction, which is then attenuated every rotation of the engine or every predetermined time interval at a predetermined attenuation rate to zero.

Further, when the intake pressure PM begins to increase posterior to the increase in the throttle valve opening TA, an intake pressure increase correction (hereinafter referred to as "PM increase correction"), in which a highly accurate correction is obtained in accordance with increasing speed of the intake pressure PM, is achieved from the time $t_3$ as indicated by a solid line C in FIG. 3(D). Specifically stating, for example, this PM increase correction value is obtained such that a value (positive value) obtained by integrating values each corresponding to a varying value with every predetermined time of the intake pressure PM is made to be a coefficient F of correction, which is then attenuated every rotation of the engine or every predetermined time interval at a predetermined attenuation rate to zero.

In this case, during a time period between the times $t_2$ and $t_3$, the LL increase correction and the TA increase correction are overlapped with each other, during a time period between the times $t_3$ and $t_4$, all of the increase correction are overlapped, and further, during a time period between the times $t_4$ and $t_5$, the TA increase correction and the PM increase correction are overlapped with each other. If all of the increase corrections are overlapped to obtain the increase correction value, particularly, there will be such a possibility that an excessively increase correction value be brought about due to the influences of the LL increase correction and the TA increase correction which are quick in response, but low in accuracy. In consequence, in this embodiment, the increase correction value for acceleration is obtained by plotting the maximal values of the LL increase correction, the TA increase correction and the PM increase correction as indicated by thick solid line in FIG. 3(D).

Next, during deceleration, when the throttle valve 18 begins to be closed from the time $t_6$, prior to a decrease in the intake pressure PM, the throttle valve opening decrease correction (hereinafter referred to as "TA decrease correction"), in which a quick correction is obtained in accordance with the decreasing speed of the throttle valve opening TA, is achieved as indicated by a solid line D in FIG. 3(D). Specifically stating, for example, this TA decrease correction value is obtained such that a value (negative value) obtained by integrating values each corresponding to a varying value with every predetermined time of the throttle valve opening TA is made to be a coefficient F of correction, which is then restored every rotation of the engine or every predetermined time interval at a predetermined restoration rate to zero.

Subsequently, when the intake pressure PM begins to decrease, an intake pressure decrease correction (hereinafter referred to as "PM decrease correction"), in which a highly accurate correction is obtained in accordance with the decreasing speed of the intake pressure PM, is achieved as indicated by a solid line E in FIG. 3(D). Specifically stating, for example, this PM decrease correction value is obtained such that a value (negative value) obtained by integrating values each corresponding to a varying value with every predetermined time of the intake pressure PM is made to be a coefficient F of correction, which is then restored every rotation of the engine or every predetermined time interval at a predetermined restoration rate to zero.

In this case, if both the TA decrease correction and the PM decrease correction are obtained together when the both decrease corrections are overlapped with each other, there will be a possibility that an excessively decrease correction value be brought about. In consequence, in this embodiment, as indicated by thick solid line in FIG. 3(D), by plotting the minimal values of the TA decrease correction and the PM decrease correction, only the TA decrease correction is obtained during a period between the times $t_7$ and $t_8$ and also only the PM decrease correction is obtained during a period between the times $t_8$ and $t_9$.

Further, in obtaining the aforesaid PM increase or decrease correction value, when a change in value $\Delta PM_1$ of the intake pressure in every first predetermined time period $\Delta t_1$ exceeds a first criterion value $1_1$, an increase or a decrease correction is effected, in case the change in value $\Delta PM_1$ does not exceed the first criterion value $1_1$, if a change in value $\Delta PM_2$ of the intake pressure in every second predetermined time period $\Delta t_2$ being longer than the first predetermined time period $\Delta t_1$ exceeds a second criterion value $1_2$, an increase or a decrease correction is effected, and if the change in value $\Delta PM_2$ does not exceed the second criterion value $1_2$, neither an increase or a decrease correction is effected.

Figure 4:
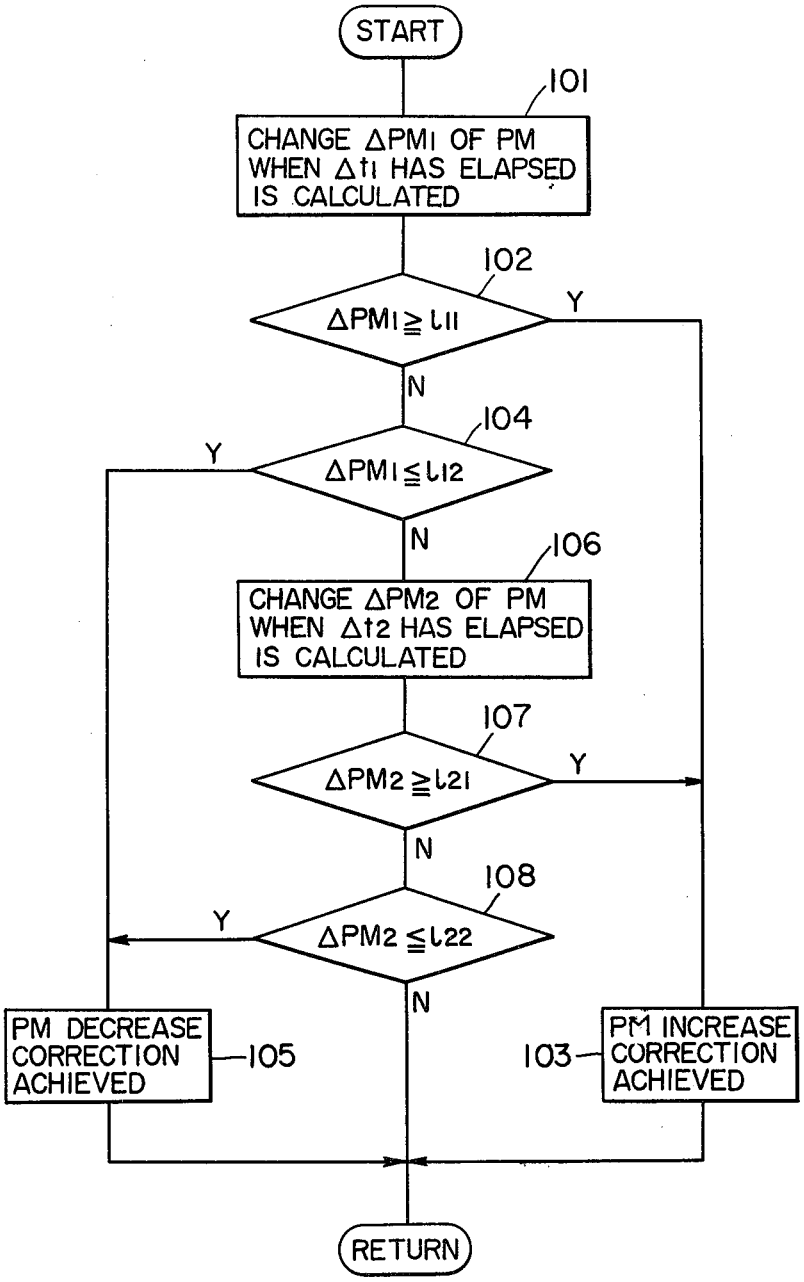
FIG. 4 is a flow chart showing the program for judging whether an increase correction for acceleration or a decrease correction for deceleration in accordance with the change of an intake pressure, is to be effected or not, which is used in the first embodiment.

More specifically, as shown in FIG. 4, firstly, in Step 101 of a process, the change in value $\Delta PM_1$ of the intake pressure PM when the first predetermined time period $\Delta t_1$ has elapsed is calculated. Subsequently, the process goes forward to Step 102, and when the change in value $\Delta PM_1$ thus calculated exceeds the first criterion value $1_{11}$ for achieving the PM increase correction, the process goes forward to Step 103, where the PM increase correction is achieved as aforesaid.

On the other hand, when the judgement in Step 102 issues a negative result, the process goes forward to Step 104, where the change in value $\Delta PM_1$ of the intake pressure calculated in the preceding Step 101 is judged whether it is less than the first criterion value $1_{12}$(negative value) for achieving the PM decrease correction or not. When the result of judgment is positive, the process goes forward to Step 105, where, the PM decrease correction is achieved as aforesaid.

Further, when both the results of judgement in Steps 102 and 104 are negative, i.e., the change in value $\Delta PM_1$ of the intake pressure when the first predetermined time period $\Delta t_1$ has elapsed does not exceed the first criterion value $1_{11}$ or $1_{12}$, the process goes forward to Step 106, where the change in value $\Delta PM_2$ of the intake pressure PM when the second predetermined time period $\Delta t_2$ being longer than first predetermined time period $\Delta t_1$, has elapsed. Subsequently, the process goes forward to Step 107, where judgement is made whether the change in value $\Delta PM_2$ thus calculated exceeds the second criterion value $1_{21}$ for achieving the PM increase correction or not. When the result of judgement is positive, the process goes forward to the aforesaid Step 103, where the PM increase correction is achieved as aforesaid. On the other hand, when the result of judgement in Step 107 is negative, the process goes forward to Step 108, where judgement is made whether the change in value $\Delta PM_2$ calculated in Step 106 is less than the second criterion value $1_{22}$ (negative value) for achieving the PM decrease correction or not. When the result of judgement is positive, the process goes forward to the aforesaid Step 105, where the PM decrease correction is achieved as aforesaid. Additionally, when both the results of judgement in Steps 107 and 108 are negative, neither the PM increase correction nor the PM decrease correction is achieved.

As has been described hereinabove, there are detected both changes including a quick change of the intake pressure PM not detectable when the time periods for judgement are long and uniform, and a slow change of the intake pressure PM not detectable when the time periods for judgement are short and uniform, so that both the increase or decrease correction excellent in responsiveness, suitable for a change in a short time period ($\Delta t_1$) of the intake pressure PM and the increase or decrease correction, suitable for a change of the intake pressure over a long time ($\Delta t_2$) can be effected, thereby enabling to effect the quick and accurate correction of the air-fuel ratio.

In addition respectively different values may be used as the aforesaid criterion values $1_{11}$, $1_{12}$, $1_{21}$ and $1_{22}$, and one and the same value (absolute value) is usable.

Detailed description will hereunder be given of a second embodiment of the present invention.

According to the present embodiment of a D-J type electronic fuel injection device of an engine 10 for a motor vehicle, comprising an air cleaner 12, an intake air temperature sensor 14, an intake air passage 16, a throttle valve 18, a throttle sensor 20, a surge tank 22, an intake pressure sensor 23, a bypass passage 24, an idle speed control valve 26, an intake manifold 28, injectors 30, an exhaust manifold 32, an oxygen concentration sensor 34, an exhaust pipe 36, a three-way catalytic converter 38, a distributor 40, a top dead center sensor 42, a crank angle sensor 44, a coolant temperature sensor 46, a transmission 98, a vehicle speed sensor 50, a coil 52 with an igniter and a digital control circuit 54 as shown in FIGS. 1 and 2 and similar to those in the preceding first embodiment, in the aforesaid digital control circuit 54, to effect an increase correction for acceleration or a decrease correction for deceleration, there are combined three correction values including an after-idle correction in which a correction value is increased to a predetermined level when the idle switch of the throttle sensor 20 is turned "OFF", a throttle valve opening increase or decrease correction in which a correction value is obtained in accordance with a changing speed of the throttle valve opening detected from an output from the potentiometer of the throttle sensor 20, and an intake pressure increase or a decease correction in which, in accordance with a changing speed of an intake pressure as detected from an output from the intake pressure sensor 23, when a change in value of the intake pressure in every first predetermined time period exceeds a first criterion value, an increase or a decrease correction is effected, in case the change in value of the intake pressure in every first predetermined time period does not exceed the first criterion value, if a change in value of the intake pressure in every second predetermined time period being longer than the first predetermined time period exceeds a second criterion value, only an increase correction is effected, and if the change in value of the intake pressure does not exceed the second criterion value, neither an increase nor a decrease correction is effected, and further, when the change in value of the intake pressure after the first predetermined time period has been elapsed exceeds the first criterion value, the count starting point of the second predetermined time period is made to be the time at which the first predetermined time period has elapsed. Since other respects in this embodiment are similar to those in the preceding first embodiment, description thereof will be omitted.

Figure 5:
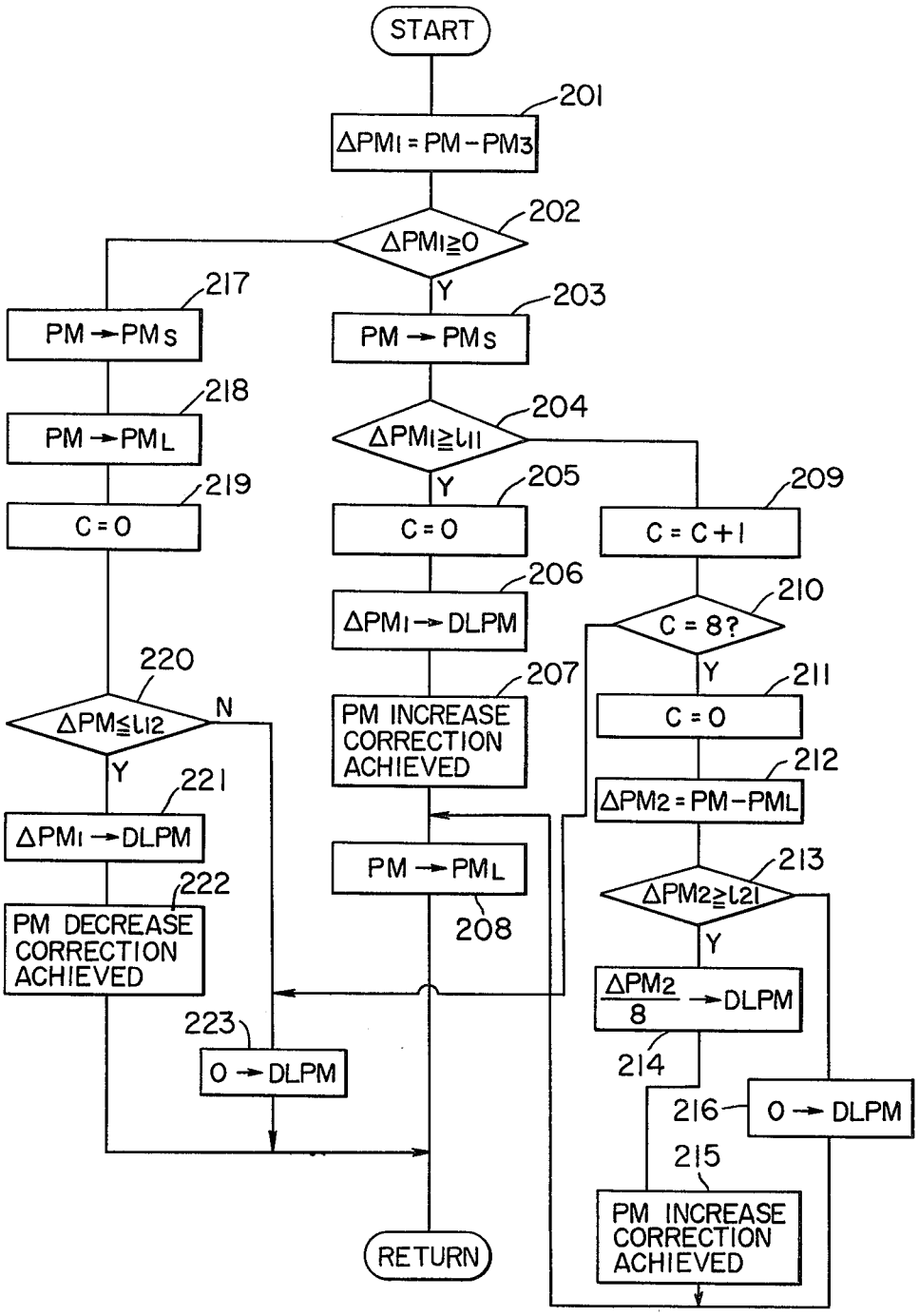
FIG. 5 is a flow chart showing the program for judging whether an increase correction for acceleration or a decrease correction for deceleration in accordance with the change of an intake pressure, is to be effected or not, which is used in a second embodiment of a D-J type electronic fuel injection device of an engine for a motor vehicle adopting the electronic fuel injecting method for an internal combustion engine according to the present invention.

Judgement of whether the PM increase or decrease correction is achieved or not in the second embodiment is made in accordance with a flow chart as shown in FIG. 5.

More specifically, firstly, in Step 201, a change in value $\Delta PM_1$ of the intake pressure PM after the first predetermined time period $\Delta t_1$(for example 20 ms) has elapsed is calculated from the intake pressure PM at present and an intake pressure $PM_s$ the first predetermined time period $\Delta t_1$ ago by the following equation.

$$\Delta PM_1 = PM - PM_s \quad (2)$$

Subsequently, the process goes forward to Step 202, where judgement is made whether the change in value $\Delta PM_1$ thus calculated is more than zero or not. When the result of judgement is positive, i.e., the intake pressure PM is on the increase or constant in value, the process goes forward to Step 203, where the intake pressure PM at present is put into the intake pressure $PM_s$ the first predetermined time period $\Delta t_1$ ago, preparing for the succeeding calculation. Further, the process goes forward to Step 204, where judgement is made whether the change in value $\Delta PM_1$ calculated in Step 201 exceeds the first criterion value $1_{11}$ for achieving the PM increase correction or not. When the result of judgement is positive, the process goes forward to Step 205, where zero is put into a counter C for counting the elapsed time in every 20 ms to reset it. Subsequently, the process goes forward to Step 206, where the value of the change in value $\Delta PM_1$ is stored in a resister DLPM used for calculating the increase correction value. Further, the process goes forward to Step 207, where the PM increase correction is achieved in the same manner as in the first embodiment. Subsequently, the process goes forward to Step 208, where the intake pressure PM at present is put into the intake pressure $PM_L$ the second predetermined time period $\Delta t_2$ (for example 160 ms) ago so as to renew the initial value of the intake pressure PM for calculating the change in value $\Delta PM_2$ of the intake pressure in every second predetermined time period, thereby completing this program.

On the other hand, when the result of judgement in Step 204 is negative, the process goes forward to Step 209, where the counted value of the counter C is count up by one. Further, the process goes forward to Step 210, where judgement is made whether the counted value of the counter C has reached 8 or not. In case the result of judgement is positive, i.e., the change in value $\Delta PM_1$ of the intake pressure, when the change in value $\Delta PM_2$ of the intake pressure is judged against the second criterion value in every second predetermined time $\Delta t_2$ the last time, or when the first predetermined time period $\Delta t_1$ has elapsed, exceeds the first criterion value $1_{11}$, if the second predetermined time period $\Delta t_2$, i.e., 160 ms, has elapsed since the time at which the first predetermined time period $\Delta t_1$ has elapsed, the process goes forward to Step 211, where zero is put into the Counter C to reset it. Subsequently, the process goes forward to Step 212, where a change in value $\Delta PM_2$ of the intake pressure after the second predetermined time period $\Delta t_2$ has elapsed is calculated from the intake pressure PM at present and an intake pressure $PM_L$ the second predetermined time period $\Delta t_2$ ago by the following equation.

$$\Delta PM_2 = PM - PM_L \quad (3)$$

Subsequently, the process goes forward to Step 213, where judgement is made whether the change in value $\Delta PM_2$ thus calculated exceeds the second criterion value $1_{21}$ for achieving the PM increase correction or not. When the result of judgement is positive, the process goes forward to Step 214, where a value obtained by dividing the change in value $\Delta PM_2$ into eight is stored in the register DLPM. Here, the reason why the change in value $\Delta PM_2$ is not put into the register DLPM as it is, but divided into eight is that the change in value $\Delta PM_2$ of the intake pressure when the second predetermined time period $\Delta t_2$ has elapsed is to be converted into the same level as the change in value $\Delta PM_1$ of the intake pressure when the first predetermined time period $\Delta t_1$ has elapsed. Further, the process goes forward to Step 215, where the PM increase correction is achieved in the same manner as in the first embodiment. On the other hand, when the result of judgement in Step 213 is negative, the process goes forward to Step 216, where zero is put into the register DLPM, and the process goes forward to the aforesaid Step 208 without achieving the PM increase correction.

When the result of judgement in the aforesaid Step 202 is negative, i.e., the intake pressure PM is on the decrease, the process goes forward to Step 217, where the intake pressure PM at present is put into the intake pressure $PM_s$ the first predetermined time period $\Delta t_1$ ago, and the process further goes forward to Step 218, where also the intake pressure PM at present is put into the intake pressure $PM_L$ the second predetermined time period $\Delta t_2$ ago. Further, the process goes forward to Step 219, where the counter C is reset, and thereafter, in Step 220, judgement is made whether the change in value $\Delta PM_1$ of the intake pressure calculated in the aforesaid Step 201 is less than the first criterion value $1_{12}$ (negative value) for achieving the PM decrease correction or not. When the result of judgement is positive, the process goes forward to Step 221, where the change in value $\Delta PM_1$ is stored in the register DLPM, and thereafter, in Step 222, the PM decrease correction is achieved in the same manner as in the first embodiment, thereby completing this program. On the other hand, when the result of judgement in the aforesaid Step 220 is negative, the process goes forward to Step 223, where zero is put into the register DLPM, thereby completing this program without achieving the PM decrease correction.

Figure 6:
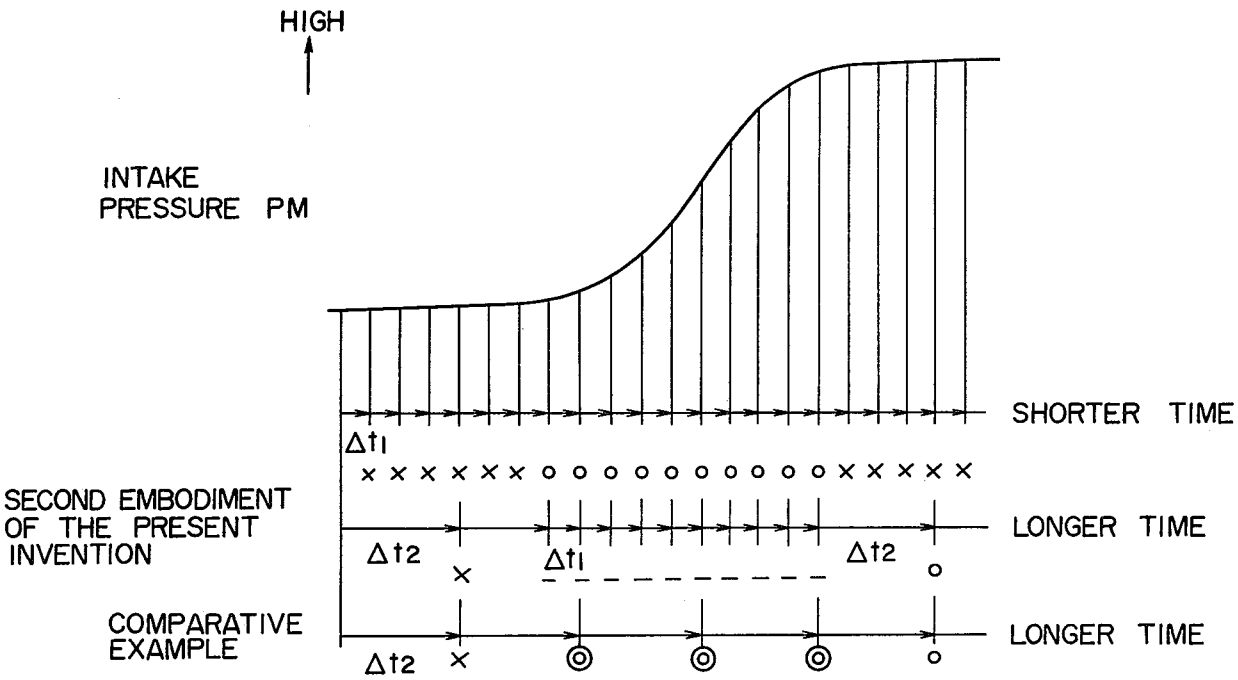
FIG. 6 is a diagram showing an example of the correlation between the progress of a change of the intake pressure and the judgment as to whether an increase correction for acceleration has been effected or not, in the second embodiment.

FIG. 6 shows an example of the correlation between the progress of change in value of the intake pressure PM and the judgement of whether the PM increase correction has been achieved or not. In the drawing, a mark 0 indicates the time at which the PM increase correction is achieved with the change in value of the pressure exceeding criterion values, a mark X the time at which the PM increase correction is not achieved with the change in value of the pressure not exceeding criterion values, and a mark—the time at which judgement against a criterion value is not made.

In the present embodiment, in achieving the PM increase correction, when the change in value $\Delta PM_1$ of the intake pressure, after the first predetermined time period $\Delta t_1$ has elapsed, exceeds the first criterion value $1_{11}$, i.e., the PM increase correction is achieved after the first predetermined time period $\Delta t_1$ has elapsed, the count starting time of the second predetermined time period $\Delta t_2$ is moved down to the time at which the first predetermined time period has elapsed, whereby the PM increase correction caused by one and the same change is not dually obtained, so that a possibility of an excessive increase correction can be eliminated. In contrast thereto, as in a comparative example as shown in FIG. 6, when no moving down of the count starting point of the second predetermined time period $\Delta t_2$ is effected, there has been a possibility of causing an excessive increase correction by an increase correction indicated by a mark ◎.

Furthermore, in the present invention, in consideration of the fact that slow decelerations rarely occur, judgement through two steps by the first predetermined time period $\Delta t_1$ and the second predetermined time period $\Delta t_2$ is effected only during an increase correction for acceleration, and, only the judgement in every first predetermined time period $\Delta t_1$ is effected during a decrease correction for deceleration, so that a satisfactory effect can be achieved by use of a comparatively short program. Needless to say, during a decrease correction for deceleration, the judgement after the second predetermined time period $\Delta t_2$ has elapsed can be effected in the same manner as in the first embodiment.

In the respective embodiments described above, during acceleration, the LL increase correction, the TA increase correction and the PM increase correction are combined to obtain an increase correction value for acceleration, and, during deceleration, the TA decrease correction and the PM decrease correction are combined to obtain a decrease correction value for deceleration. However, the combination for obtaining an increase correction value for acceleration or a decrease correction value for deceleration should not necessarily be limited to this, and, for example, the LL increase correction may be omitted.

It should be apparent to those skilled in the art that the above-described embodiments are merely representative, which represent the applications of the principles of the present invention. Numerous and varied other arrangements can be readily devised by those skilled in the art without departing from the spirit and the scope of the invention.

What is claimed is:

1. Electronic fuel injecting method for an internal combustion engine, wherein a basic injection time is obtained in accordance with an intake pressure of the engine and an engine rotational speed, and, during transition, said basic injection time is corrected in accordance with the operating conditions of said engine so as to determine a fuel injection time, characterized in that, when a change in value of the intake pressure in every first predetermined time period exceeds a first criterion value, an increase correction for acceleration or a decrease correction for deceleration is effected, in case said change in value of the intake pressure in every first predetermined time period does not exceed said first criterion value, if a change in value of the intake pressure in every second predetermined time period being longer than said first predetermined time period exceeds a second criterion value, at least an increase correction for acceleration is effected, and if said change in value of the intake pressure does not exceed said second criterion value, neither an increase correction for acceleration nor a decrease correction for deceleration is effected.

2. Electronic fuel injecting method for an internal combustion engine, wherein a basic injection time is obtained in accordance with an intake pressure of the engine and an engine rotational speed, and, during transition, said basic injection time is corrected in accordance with the operating conditions of said engine so as to determine a fuel injection time, characterized in that, when a change in value of the intake pressure in every first predetermined time period exceeds a first criterion value, an increase correction for acceleration or a decrease correction for deceleration is effected, in case said change in value of the intake pressure in every first predetermined time period does not exceed said first criterion value, if a change in value of the intake pressure in every second predetermined time period being longer than said first predetermined time period exceeds a second criterion value, at least an increase correction for acceleration is effected, and if said change in value of the intake pressure does not exceed said second criterion value, neither an increase correction for acceleration nor a decrease correction for deceleration is effected, and further, when said change in value of the intake pressure after said first predetermined time period has elapsed exceeds said first criterion value, a count starting point of said second predetermined time period is made to be the time at which said first predetermined time period has elapsed.

3. Electronic fuel injecting method for an internal combustion engine as set forth in claim 1 or 2, wherein said increase correction for acceleration is obtained such that a positive value obtained by integrating values each corresponding to a varying value with every predetermined time of the intake pressure is made to be a coefficient of correction, which is then attenuated every predetermined interval to a predetermined level variable in accordance with the temperature of engine coolant at a predetermined high attenuation rate, and after the predetermined level is reached, to zero at a predetermined low attenuation rate.

4. Electronic fuel injecting method for an internal combustion engine as set forth in claim 1 or 2, wherein said decrease correction for deceleration is obtained such that a negative value obtained by integrating values each corresponding to a varying value with every predetermined time of the intake pressure is made to be a coefficient of correction, which is then restored every predetermined interval to a predetermined level variable in accordance with the temperature of engine coolant at a predetermined high restoration rate, and after the predetermined level is reached, to zero at a predetermined low restoration rate.

5. Electronic fuel injecting method for an internal combustion engine as set forth in claim 1 or 2, wherein the length of said second predetermined time period is about 8 times that of said first predetermined time period.

6. Electronic fuel injecting method for an internal combustion engine as set forth in claim 1 or 2, wherein the value of an increase correction for acceleration or a decrease correction for deceleration when said second predetermined time period has elapsed is decreased from the value of an increase correction for acceleration or a decrease correction for deceleration when said first predetermined time period has elapsed in a proportion of the length of said second predetermined time period to the length of said first predetermined time period.

7. Electronic fuel injecting method for an internal combustion engine as set forth in claim 1 or 2, wherein said second criterion value is made to be equal in value to said first criterion value.

8. Electronic fuel injection device for an internal combustion engine, comprising:

an intake air temperature sensor for detecting the temperature of intake air taken in by an air cleaner;

a throttle sensor including an idle switch for detecting whether a throttle valve is in an idle opening or not and a potentiometer for generating a voltage output proportional to the opening of the throttle valve;

an intake pipe pressure sensor for detecting an intake pressure through a pressure in a surge tank;

an injector for blowing fuel out into the engine;

a crank angle sensor for outputting a crank angle signal in accordance with a rotation of the engine;

a coolant temperature sensor for detecting the temperature of engine coolant; and a digital control circuit wherein a basic injection time is obtained through a map in accordance with an intake pressure fed from said intake pressure sensor and an engine rotational speed obtained from an output from said crank angle sensor, said basic injection time thus obtained is corrected in accordance with at least an output from said throttle sensor and the temperature of engine coolant fed from said coolant temperature sensor to determine a fuel injection time and output an injector opening time signal to the injector, and further, to obtain an increase correction value for acceleration or a decrease correction value for deceleration, there are combined three values including an after-idle increase correction in which a correction value is increased to a predetermined level when the idle switch is turned "OFF", a throttle valve opening increase or decrease correction in which a correction value is obtained in accordance with a changing speed in opening of a throttle valve as detected from an output from the potentiometer of said throttle sensor, and an intake pressure increase or decrease correction in which, in accordance with a changing speed of an intake pressure as detected from an output from said intake pressure sensor, when a change in value of the intake pressure in every first predetermined time period exceeds a first criterion value, an increase correction for acceleration or a decrease correction for deceleration is effected, in case the change in value of the intake pipe pressure in every first predetermined time period does not exceed said first criterion value, if a change in value of the intake pressure in every second predetermined time period being longer than said first predetermined time period exceeds a second criterion value, an increase correction for acceleration or a decrease correction for deceleration is effected, and if said change in value of the intake pressure does not exceed the second criterion value, neither an increase correction for acceleration nor a decrease correction for deceleration is effected.

9. Electronic fuel injection device for an internal combustion engine, comprising:

an intake air temperature sensor for detecting the temperature of intake air taken in by an air cleaner;

a throttle sensor including an idle switch for detecting whether a throttle valve is in an idle opening or not and a potentiometer for generating a voltage output proportional to the opening of the throttle valve;

an intake pipe pressure sensor for detecting an intake pressure through a pressure in surge tank;

an injector for blowing fuel out into the engine;

a crank angle sensor for outputting a crank angle signal in accordance with a rotation of the engine;

a coolant temperature sensor for detecting the temperature of engine coolant; and a digital control circuit wherein a basic injection time is obtained through a map in accordance with an intake pressure fed from said intake pressure sensor and an engine rotational speed obtained from an output from said crank angle sensor, said basic injection time thus obtained is corrected in accordance with at least an output from said throttle sensor and the temperature of engine coolant fed from said coolant temperature sensor to determine a fuel injection time and output an injector opening time signal to said injector, and further, to obtain an increase correction value for acceleration or a decrease correction value for deceleration, there are combined three values including an after-idle increase correction in which a correction value is increased to a predetermined level when the idle switch is turned "OFF", a throttle valve opening increase or decrease correction in which a correction value is obtained in accordance with a changing speed in opening of a throttle valve as detected from an output from the potentiometer of said throttle sensor, and an intake pressure increase or decrease correction in which, in accordance with a changing speed of an intake pressure as detected from an output from said intake pressure sensor, when a change in value of the intake pressure in every first predetermined time period exceeds a first criterion value, an increase correction for acceleration or a decrease correction for deceleration is effected, in case the change in value or the intake pressure in every first predetermined time period does not exceed said first criterion value, if a change in value of the intake pressure in every second predetermined time period being longer than said first predetermined time period exceeds a second criterion value, only an increase correction for acceleration is effected, and if said change in value of the intake pressure does not exceed said second criterion value, neither an increase correction for acceleration nor a decrease correction for deceleration is effected, and further, when said change in value of the intake pressure after said first predetermined time period has been elapsed exceeds said first criterion value, a count starting point of said second predetermined time period is made to be the time at which said first predetermined time period has elapsed.

* * * * *